US009291311B2

(12) United States Patent
Chen et al.

(10) Patent No.: US 9,291,311 B2
(45) Date of Patent: Mar. 22, 2016

(54) ILLUMINATION APPARATUS

(71) Applicants: Kuo Hsun Chen, Toufen Town, Miaoli County (TW); Hsun Ching Chiang, Hsinchu (TW); Yi An Sha, New Taipei (TW); Hsiang Yun Yang, Hsin-Chu Hsien (TW)

(72) Inventors: Kuo Hsun Chen, Toufen Town, Miaoli County (TW); Hsun Ching Chiang, Hsinchu (TW); Yi An Sha, New Taipei (TW); Hsiang Yun Yang, Hsin-Chu Hsien (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 111 days.

(21) Appl. No.: 14/135,822

(22) Filed: Dec. 20, 2013

(65) Prior Publication Data

US 2015/0036344 A1 Feb. 5, 2015

(30) Foreign Application Priority Data

Aug. 5, 2013 (TW) ..... 102127933 A

(51) Int. Cl.

| | |
|---|---|
| ***F21V 29/00*** | (2015.01) |
| ***F21K 99/00*** | (2010.01) |
| ***F21V 29/87*** | (2015.01) |
| *F21Y 101/02* | (2006.01) |
| *F21Y 111/00* | (2006.01) |

(52) U.S. Cl.

CPC ..... *F21K 9/1355* (2013.01); *F21V 29/87* (2015.01); *F21Y 2101/02* (2013.01); *F21Y 2111/005* (2013.01)

(58) Field of Classification Search

CPC ..... F21K 9/1355; F21V 29/87
USPC ..... 362/249.01, 650
See application file for complete search history.

(56) References Cited

U.S. PATENT DOCUMENTS 5,785,418 A * 7/1998 Hochstein ..... 362/373
2011/0214852 A1* 9/2011 Wang ..... C09K 5/00 165/185

FOREIGN PATENT DOCUMENTS

| | | | |
|---|---|---|---|
| CN | 203082588 | | 7/2013 |
| CN | 203082588 U | * | 7/2013 |
| TW | 201120377 A | | 6/2011 |

* cited by examiner

*Primary Examiner* — David V Bruce
(74) *Attorney, Agent, or Firm* — Egbert Law Offices, PLLC

(57) ABSTRACT

An illumination apparatus comprises a heat sink, at least one light module and an insulating adhesive layer. The light module is disposed on the heat sink, and the insulating adhesive layer is disposed between the light module and heat sink to combine the light module with the heat sink. The insulating adhesive layer comprises polymer component and heat conductive filler dispersed therein. The polymer comprises thermoset epoxy resin. The insulating adhesive layer has heat conductivity greater than 0.5 W/m-K and a thickness of 0.02-10 mm. The bonding strength of the insulating adhesive layer to the heat sink and the light module is greater than 300 g/cm$^2$, and the insulating adhesive layer can withstand a voltage of at least 500 volts.

17 Claims, 5 Drawing Sheets

ILLUMINATION APPARATUS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to an illumination apparatus, and more particular to an illumination apparatus with high heat conductivity and insulative capability.

2. Description of Related Art Including Information Disclosed Under 37 CFR 1.97 and 37 CFR 1.98.

The light emitting diodes (LEDs) have been used since 1960s, and usually used as indicating or signal lights. Because traditional LEDs do not have high power consumption, heat dissipation of LED packaging was not an issue. In recent years, lightness and power consumption of the LEDs used for television backlights or illumination have become increasingly high, and therefore heat dissipation becomes a crucial problem for LED illumination applications.

A traditional incandescent lamp dissipates about 70% heat by infrared radiation, so that heat accumulation in the lamp is not obvious. However, an LED usually emits visible light or ultra-violent light, and therefore it does not easily dissipate heat by radiation. In addition, small LED packaging area is hard to dissipate heat efficiently, resulting in LED luminous decay. Therefore, heat management is important for LED illumination applications.

Traditionally, LEDs transfer heat to a substrate through a metal lead frame, and thermal resistance of package is very high, e.g., 250-300° C./W. Then, LEDs are surface-mounted on to circuit board for packaging, in which a resin layer (FR4) adhered to the circuit board is used for heat transfer. The large heat dissipation area can significantly decrease thermal resistance. However, FR4 may not be suitable for packaging of high power LED due to its low heat conductivity coefficient though it is still used in low-end products owing to its low cost. To increase heat conductivity, ceramic substrates are used; however, the ceramic substrates are brittle and costly. In addition, a metal core circuit board (MCPCB) using an aluminum substrate may be used. MCPCB has good heat conductivity, but it cannot provide good insulation. Therefore, MCPCB needs to associate with extra insulative design.

Nowadays, as to LEDs, heat-source devices or other electronic devices, a thermal interface material is employed to combine such devices with a heat dissipation structure. The thermal interface material usually contains an organic silicon polymer, organic phase transition material or heat-conductive paste. Although these materials perform good heat conductivity, they are not sticky enough. Therefore, the combination needs auxiliary components such as screws, rivets, or tenons. These traditional materials may degrade to generate small molecules cracking products after being used for a long time, resulting in lower heat conductivity and contamination to electronic devices.

It is necessary to take both the painting and process behaviors into account for commercial heat conductive pastes and double-side adhesives of epoxy resin series. Large amount of ceramic powder increases heat conductivity; however, excessive ceramic powder causes high viscosity which is detrimental to painting process and tremendously reduces adhesive strength.

Accordingly, it is demanded to provide an effective solution for LED illumination in consideration of insulation, heat-conductivity and adhesive strength in the situation without auxiliary fixing components such as screws.

BRIEF SUMMARY OF THE INVENTION

The present application provides an illumination apparatus in which an insulating adhesive layer is adapted to combine one or more light modules with a heat sink. The insulating adhesive layer is high heat-conductive, insulative and adhesive. There is no need to use fixing components such as screws, tenons, or rivets to joint the light module to the heat sink, thereby increasing design flexibility of the light module and providing an illumination apparatus of large light-emitting angle or omni-directional lighting.

In accordance with an embodiment of the present application, an illumination apparatus comprises a heat sink, at least one light module and an insulating adhesive layer. The light module is disposed on the heat sink, and the insulating adhesive layer is disposed between the light module and heat sink to adhere the light module to the heat sink. The insulating adhesive layer comprises polymer component and heat conductive filler dispersed therein. The polymer component comprises thermoset epoxy resin. The insulating adhesive layer has heat conductivity greater than 0.5 W/m-K and a thickness of 0.02-10 mm. The bonding strength of the insulating adhesive layer to the heat sink and the light module is greater than 300 g/cm$^2$, and the insulating adhesive layer can withstand a voltage plat least 500 volts.

In an embodiment, a covered area of the light module is less than a covered area of the insulating adhesive layer. The covered area of the light module preferably comprises 65%-95% of the covered area of the insulating adhesive layer.

In an embodiment, the light module comprises a lighting device and a circuit substrate, and the lighting device is disposed on the circuit substrate.

In an embodiment, the covered area of the insulating adhesive layer is larger than the covered area of the light module. In particular, if the ratio of the covered area of the light module to the covered area of the insulating adhesive layer ranges from 25% to 93%, the lighting device can withstand a voltage ranging from 1 kV to 10 kV without electric arc.

In an embodiment, the covered area of the insulating adhesive layer is less than the covered area of the light module. In particular, if the ratio of the covered area of the light module to the covered area of the insulating adhesive layer ranges from 100% to 300%, the lighting device can withstand a voltage of ranging from 0.8 kV to 3.4 kV without electric arc.

In an embodiment, the illumination apparatus further comprises base shell, and the heat sink sticks out of the top of the base shell. The heat sink may be in the form of a cylinder. The light module is disposed on the top surface and/or the lateral surface of the cylinder. The insulating adhesive layer caps the top of the heat sink and extends downward to cover an area where the light module is located. Alternatively, the heat sink may be in the form of a polygonal column, and the light module is disposed on the top surface and/or the lateral surfaces of the polygonal column. The insulating adhesive layer caps the top surface of the heat sink and extends downward to cover an area where the light module is located.

In an embodiment, the polymer component further comprises thermoplastic, and the heat conductive filler may comprise zirconium nitride, boron nitride, aluminum nitride, silicon nitride, aluminum oxide, magnesium oxide, zinc oxide, silicon oxide, titanium oxide, silicon carbide, gold, silver, aluminum or the mixture thereof.

In an embodiment, the insulating adhesive layer exhibits a hardness of 65 A to 85 A according to ASTM D2240, and has a thermal resistance below 0.5° C./W which is measured according to ASTM D5470.

The insulating adhesive layer of the present application does not generate liquefied residue or outgas caused by material degradation. In contrast, the insulating adhesive layer has high heat conductivity and superior adhesive strength, and therefore it is advantageous to be applied to LED illuminations in demand on high heat transfer efficiency.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

To resolve the aforesaid heat management problems of the high power illumination apparatus, an insulating adhesive layer of high heat conductivity and superior adhesive strength is employed to bond the light module with the heat sink, so as to effectively transfer the heat generated from the light module to the heat sink. The cover area of the insulating adhesive layer is optimized in obtaining superior insulation and voltage endurance to avoid electric arc.

Figure 1:
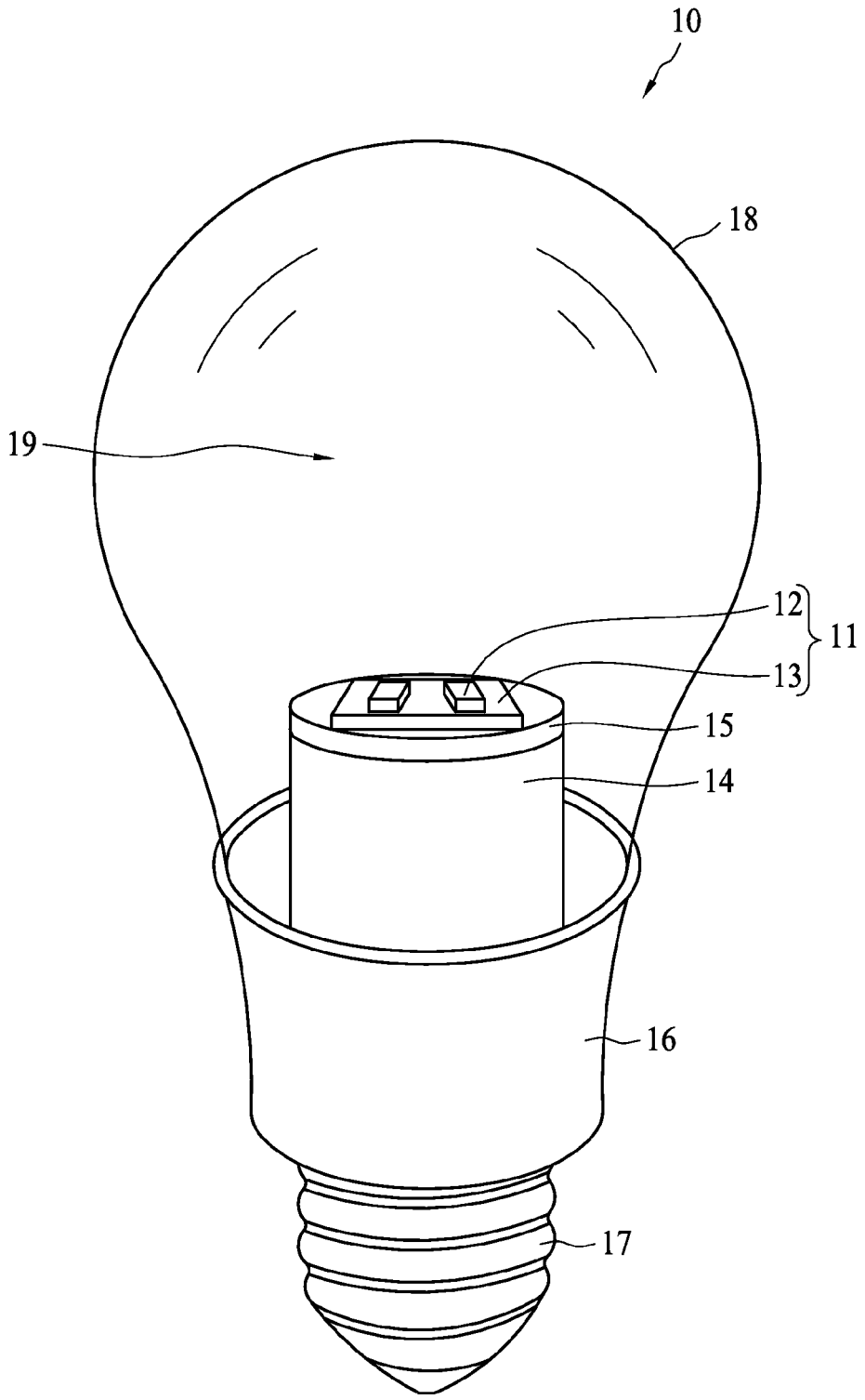
FIG. 1 shows an illumination apparatus in accordance with a first embodiment of the present application.
Figure 2:
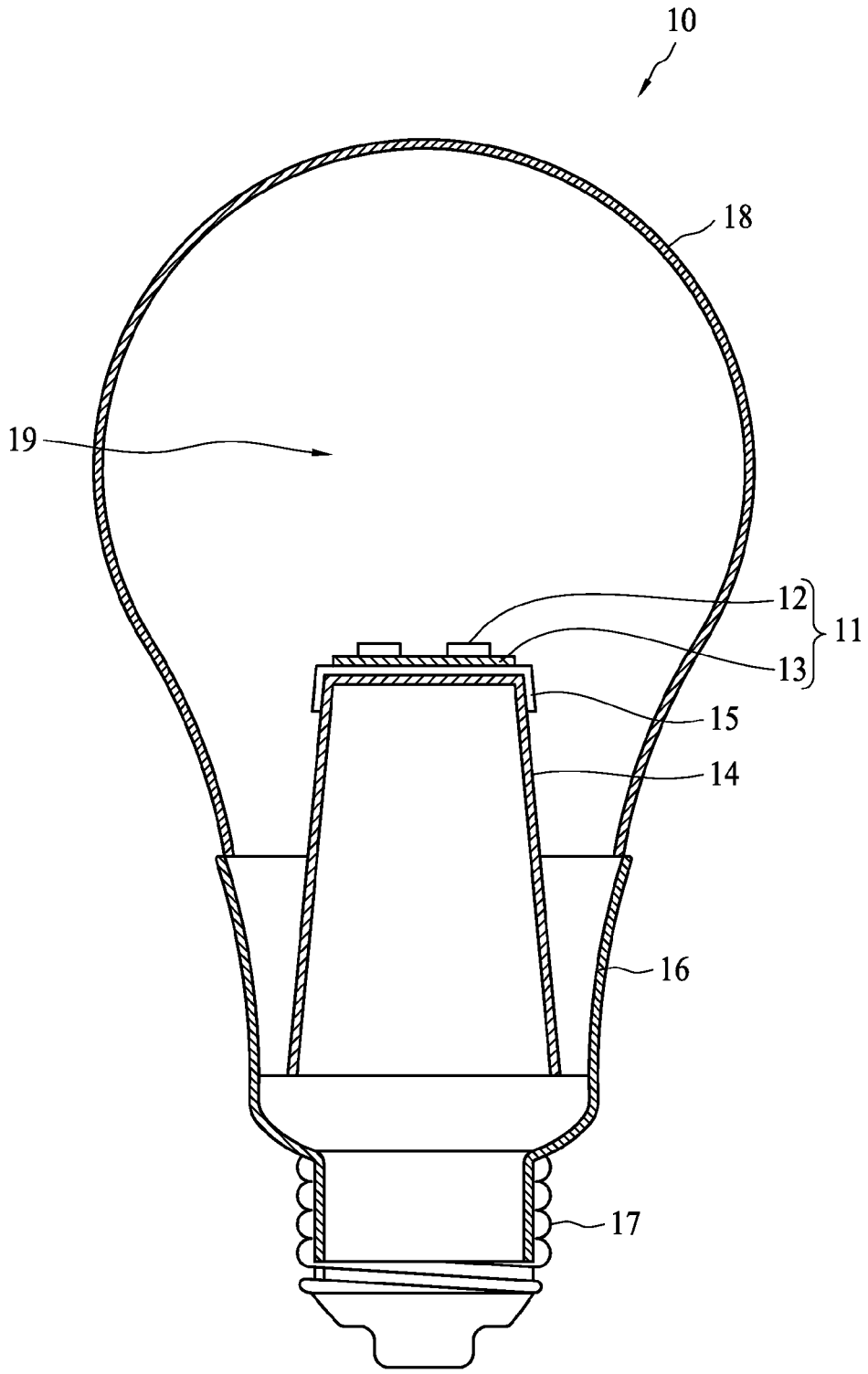
FIG. 2 shows a cross-sectional side view of the illumination apparatus in accordance with the first embodiment of the present application.

FIGS. 1 and 2 show an illumination apparatus in accordance with a first embodiment. A three-dimensional view and a cross-sectional side view of the illumination apparatus are shown in FIG. 1 and FIG. 2, respectively. An illumination apparatus 10 comprises a light module 11, a heat sink 14, an insulating adhesive layer 15, a base shell 16, an electrical terminal 17 and a transparent cover 18. The light module 11, essentially comprising lighting devices 12 and a circuit substrate 13, is disposed on the top of the heat sink 14. Each lighting device 12 may comprise at least one LED, and is disposed on the circuit substrate 13. The transparent cover 18 may be a transparent lampshade of which a bottom connects to the base shell 16 to form a space 19 receiving the light module 11, a part of heat sink 14 and the insulating adhesive layer 15. The base shell 16 is adapted to receive a driving circuit board or other electronic devices. The bottom of the base shell 16 connects to the electrical terminal 17 which is adapted to connect to a power source.

In this embodiment, the heat sink 14 may be a cylindrical platform sticking out of the base shell 16 and has a top surface on which the light module 11 is disposed. The heat sink 14 sticks out of the base shell 16 by about ⅕ to ½ of the height of the transparent cover 18, and the sidewall of the heat sink 14 may be tilted by a certain angle, thereby the light module 11 can be disposed at a higher position in an attempt to obtain large light-emitting angle or omni-directional lighting. The insulating adhesive layer 15 is disposed between the light module 11 and the heat sink 14 to combine the light module 11 with the heat sink 14. To obtain the better heat dissipation and structural rigidity, the heat sink 14 is usually made from metal. However, such design would increase the probability of an electric arc between the light module 11 and the heat sink 14. To avoid electric arc, the insulating adhesive layer 15 is preferably larger than the light module 11 or the circuit substrate 13 in area, in other words, the covered area of the insulating adhesive layer 15 is preferably greater than that of the light module 11. In an embodiment, the ratio of the covered area of the light module 11 or the circuit substrate 13 to the covered area of the insulating adhesive layer 15 is in the range of 65% to 95%, or 90%, 80% or 70% in particular. In an embodiment, the insulating adhesive layer 15 covers the top of the heat sink 14 and extends downward to a certain extent. With the increase of the insulation covering area, the distance between the lighting devices 12 and the heat sink 14 not covered or protected by the insulating adhesive layer 15 will increase to prevent electric arc. Based upon test data, if the distance between the lighting device 12 and the heat sink 14 not covered by the insulating adhesive layer 15 exceeds three millimeters, the illumination apparatus 10 can withstand a voltage of 3 kV without electric arc.

Figure 3:
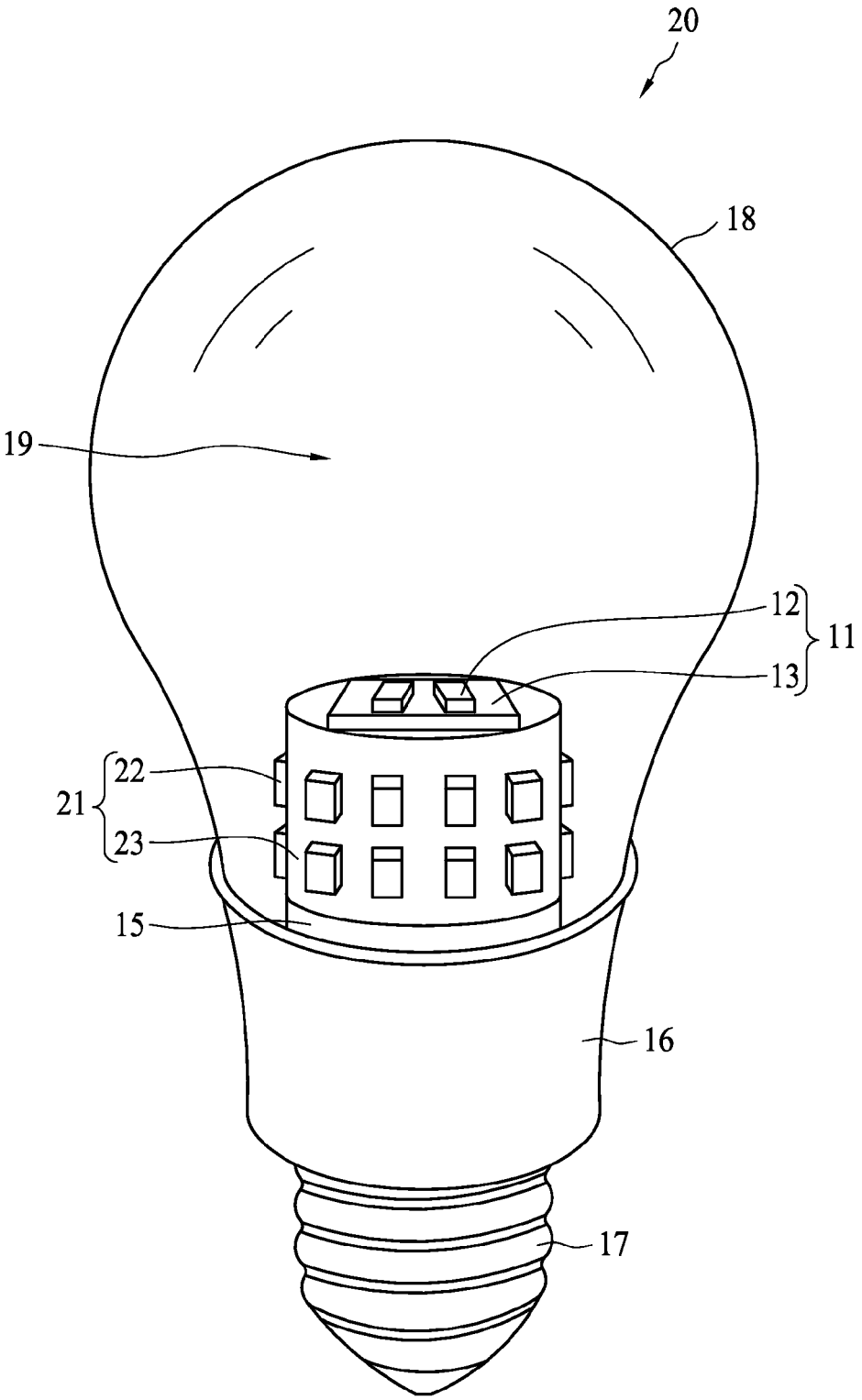
FIG. 3 shows an illumination apparatus in accordance with a second embodiment of the present application.
Figure 4:
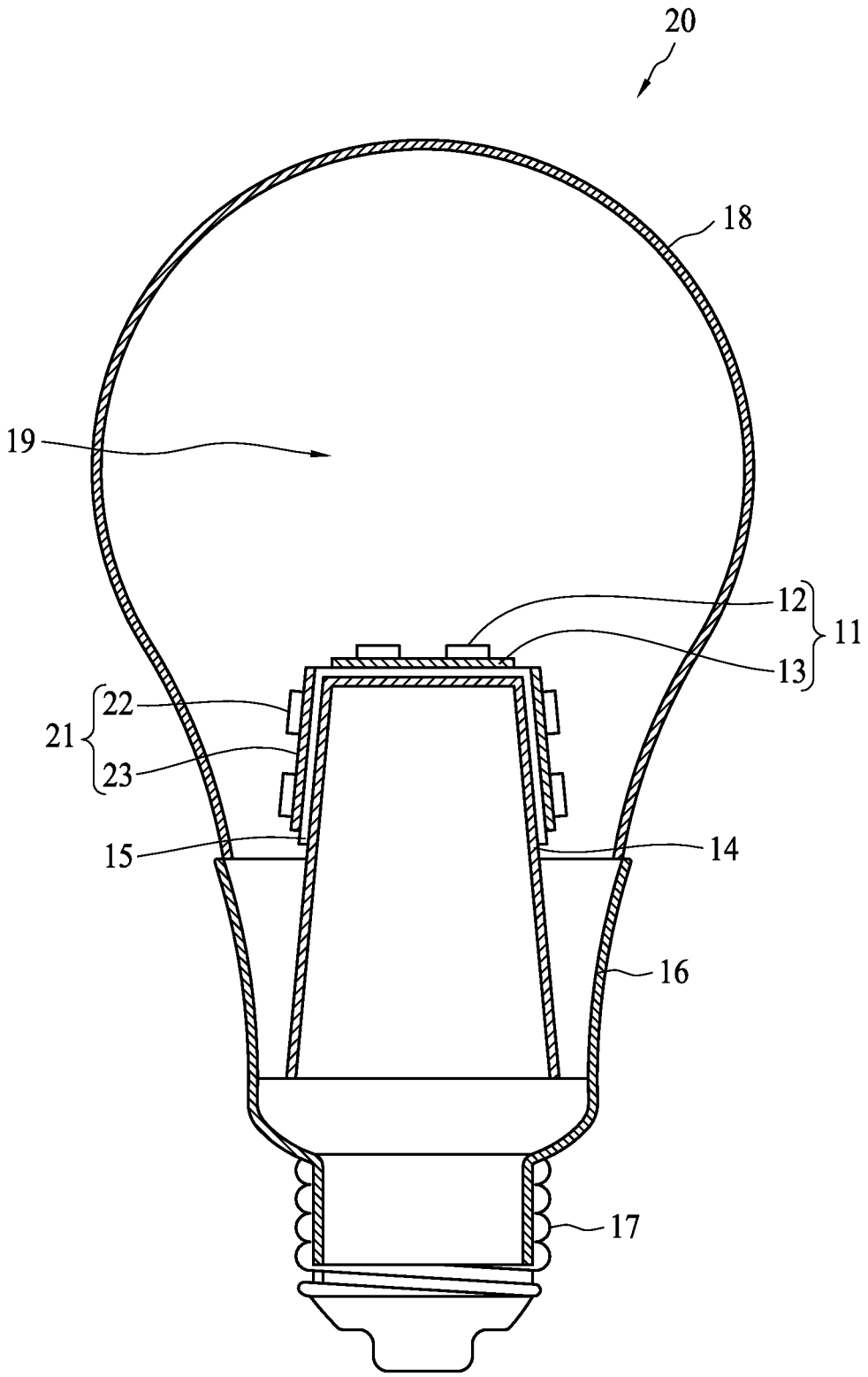
FIG. 4 shows a cross-sectional side view of the illumination apparatus in accordance with the second embodiment of the present application.

FIGS. 3 and 4 show an illumination apparatus 20 in accordance with a second embodiment of the present application. FIG. 3 is a three-dimensional view of the illumination apparatus 20, and FIG. 4 is a cross-sectional side view thereof. Similar to the aforementioned first embodiment, the illumination apparatus 20, however, further comprise a light module 21 disposed on the lateral surface of the cylindrical heat sink 14, so as to increase lateral light-emitting efficiency and light-emitting angle. The light module 21 comprises a circuit substrate 23 to which lighting devices 22 are attached. Similarly, the light modules 11 and 21 are adhered to the heat sink 14 through the insulating adhesive layer 15 formed therebetween, and the insulating adhesive layer 15 preferably has a larger area than an area where the light modules 11 and 21 or circuit substrates 13 and 23 are located. In an embodiment, a ratio of the total area of the light modules 11 and 21 or the circuit substrates 13 and 23 to the covered area of the insulating adhesive layer 15 is in the range of 65% to 95%, or may be 90%, 80% or 70% in particular. In this embodiment, the insulating adhesive layer 15 caps the top of the heat sink 14 and extends downward to exceed the place where the light module 21 is disposed. With the increase of insulating covering area, the distance between the light module 22 and the heat sink 14 not covered by the insulating adhesive layer 15 will increase to prevent electric arc. The light module 11 on the top of the heat sink 14 may be omitted if desired. For example, the heat sink 14 may be in the form of a cone to obtain a large light-emitting angle.

Figure 5:
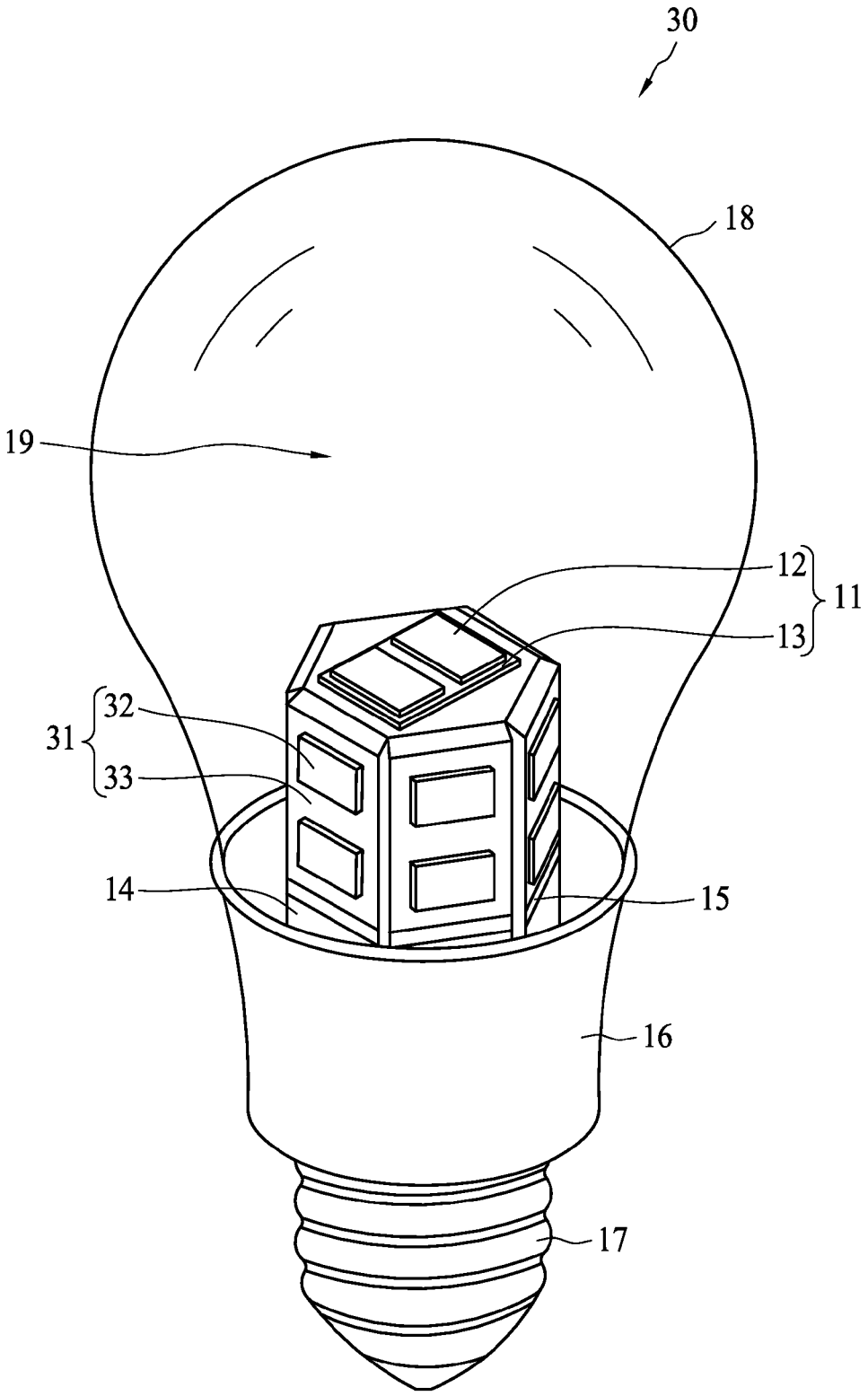
FIG. 5 shows an illumination apparatus in accordance with a third embodiment of the present application.

FIG. 5 shows an illumination apparatus 30 in accordance with a third embodiment of the present application. The illumination apparatus 30 is similar to the first embodiment except that the heat sink 14 is a polygon column, e.g., a hexagonal column. The top of the heat sink 14 is provided with a light module 11, and a light module 31 is formed on each of the lateral surfaces of the heat sink 14. The light module 31 comprises lighting devices 32 and a circuit substrate 33, and the lighting devices 32 are disposed on the circuit substrate 33. Similarly, the light modules 11 and 31 are adhered to the heat sink 14 through the insulating adhesive layer 15 formed therebetween, and the insulating adhesive layer 15 preferably has a larger area than an area where the light modules 11 and 21 or circuit substrates 13 and 23 are located. In an embodiment, a ratio of the total area of the light modules 11 and 31 or the circuit substrates 13 and 33 to the covered area of the insulating adhesive layer 15 is in the range of 65% to 95%, or may be 90%, 80% or 70% in particular. In this embodiment, the insulating adhesive layer 15 caps the top of the heat sink 14 and extends downward to exceed the place where the light module 31 is located. With the increase of insulating covering area, the distance between the lighting devices 32 and the heat sink 14 not covered by the insulation will increase to prevent electric arc. The light module 11 on the top of the heat sink 14 may be omitted if desired. For example, the heat sink 14 may be in the form of a polygonal cone to have a large light-emitting angle.

Bulb lights are exemplified in the aforementioned embodiments. However, the present application comprises but is not limited to the applications of bulb lights, and is advantageously applied to various illumination apparatuses in need of high heat-conductive applications. The illumination apparatus of the present application comprises but is not limited to the above embodiments, any structural variations are within the scope of the present application as long as they use or include an insulating adhesive layer having specific heat conductivity, insulation, and adhesive features.

To achieve the demand of heat conductivity, insulation, and adhesion concurrently, the insulating adhesive layer 15 has to have a heat conductivity greater than 0.5 W/m-K, a thickness of 0.2-10 mm. and provides a bonding, strength of at least 300 g/cm$^2$ to the heat sink 14 and the light module 11. The adhesive material of the insulating adhesive layer 15 contains polymer component and heat conductive filler dispersed therein. The polymer component comprises thermoset epoxy resin and may further comprise thermoplastic, rubber or polymeric modifier to enhance impact endurance of the thermoset epoxy resin. The insulating adhesive layer 15 has heat conductivity in the range of 0.5 W/m-K to 15 W/m-K, e.g., 1 W/m-K, 3 W/m-K, 5 W/m-K, 7 W/m-K, 8 W/m-K, 10 W/m-K, or 12 W/m-K. The light module 11, 21 or 31 is combined with the heat sink 14 by the adhesive material at appropriate temperature, e.g., greater than 50° C., and pressure, and thereafter the adhesive material forms the insulating adhesive layer 15. The adhesive material of the insulating adhesive layer 15 fills the gaps between the heat sink 14 and the light module 11, 21 or 31, thereby further decreasing thermal resistance. Based upon a measurement according to ASTM D5470, the thermal resistance of a 200 μm thick sheet made of the adhesive material is less than 0.5° C./W or 0.4° C./W. The hardness of the insulating adhesive layer 15, according to ASTM D2240, is in the range of 65 A to 98 A, e.g., 75 A, 85 A, or 95 A. It is noted that the insulating adhesive layer 15 of good impact endurance is advantageously applied to adhesion with metals. The metals may comprise copper, aluminum, nickel, iron, tin, gold, silver, or alloy thereof. After the adhesive material is pressed with the metal and is cured, the bonding strength is at least 300 kg/cm$^2$. The addition of thermoplastic into the polymer component would increase the bonding strength. Thermoplastic make the adhesive material become tough, and thus the adhesive material does not crack easily. Accordingly, the adhesive material can intensively adhere to metals such as metal electrodes or metal substrates. It is attainable to increase adhesive strength to 350 kg/cm$^2$ or 400 kg/cm$^2$ by optimizing the composition of the adhesive material. In practice, an extremely thin insulating adhesive layer 15 is obtainable, however, thicker layer 15 has better insulating and voltage-withstanding behaviors The insulating adhesive layer 15 has a thickness ranging from 0.02mm to 10 mm, or may be 0.1 mm, 0.5 mm, 1 mm, 5 mm. The insulating adhesive layer 15 usually performs superior insulating and voltage endurance behaviors if its thickness is greater than 0.2 mm.

The insulation and voltage endurance depend upon not only the thickness of the insulating adhesive layer but also the covered areas of the insulating adhesive layer and the light module. Table 1 shows the test result for voltage endurance in the situation that the covered area of the light modules is less than that of the insulating adhesive layer, e.g., the ratio "A" of the covered area of the light modules to the covered area of the insulating adhesive layer is in the range of 25% to 93%, and insulating adhesive layers are of different thicknesses. It is noted from Table 1 that the smaller ratio "A" and thicker insulating adhesive layer, i.e., the insulating adhesive layer is relatively large in area or thickness, perform better insulation and voltage endurance. Moreover, the lighting devices of the illumination apparatus can withstand a voltage ranging from 1 kV to 10 kV without electric arc; therefore the illumination apparatus is advantageously employed for high voltage applications.

TABLE 1

| Ratio | Withstand voltage (kV) | | | | | | |
|---|---|---|---|---|---|---|---|
| "A" | 0.02 mm | 0.1 mm | 0.2 mm | 0.4 mm | 1 mm | 5 mm | 10 mm |
| 93% | 1 | 1.2 | 1.3 | 1.7 | 3.2 | 4.8 | 5.6 |
| 82% | 1.2 | 1.7 | 2.1 | 3.1 | 4.4 | 5.6 | 6.1 |
| 73% | 1.4 | 2.9 | 3.3 | 3.8 | 4.9 | 6.2 | 7.3 |
| 56% | 1.4 | 3.4 | 4 | 4.5 | 5.5 | 6.9 | 8.2 |
| 36% | 1.6 | 4.1 | 4.8 | 5.2 | 6.2 | 7.2 | 9.1 |
| 25% | 1.8 | 4.6 | 5.2 | 5.6 | 6.8 | 8.3 | >10 |

In contrast, it is also applicable when the covered area of the light modules is larger than that of the insulating adhesive layer. For example, the ratio "A" of the covered area of the light modules to the covered area of the insulating adhesive layer is in the range of 100% to 300%. The test results of the insulation and voltage endurance with respect to different ratios "A" and insulating adhesive layers are shown in Table 2. The smaller ratio "A" and thicker insulating adhesive layer, i.e., the insulating adhesive layer is relatively large in area or thickness, would have better performance on insulation and voltage endurance. It can be seen from Table 2 that the lighting devices of the illumination apparatus can withstand a voltage of 0.8 kV to 3.4 kV without electric arc; therefore it can be employed for the applications without the need of high voltage endurance.

TABLE 2

| Ratio | Withstand voltage (kV) | | | | | | |
|---|---|---|---|---|---|---|---|
| "A" | 0.02 mm | 0.1 mm | 0.2 mm | 0.4 mm | 1 mm | 5 mm | 10 mm |
| 100% | 1 | 1.1 | 1.2 | 1.5 | 2.8 | 3.2 | 3.4 |
| 200% | 0.9 | 1 | 1.1 | 1.4 | 2.5 | 2.6 | 3.2 |
| 300% | 0.8 | 1 | 1.1 | 1.3 | 2.2 | 2.3 | 2.8 |

The thermoset epoxy resin may comprise uncured liquid epoxy resin, polymeric epoxy resin, phenolic epoxy resin or bisphenol A resin. The thermoset epoxy resin can be a mixture of plural polymers including end epoxy functional group epoxy resin, side chain epoxy functional group epoxy resin, tetra-functional group epoxy resin or the mixture thereof. In an embodiment, the thermoset epoxy resin may be bisphenol A epoxy resin. The thermoset epoxy resin comprises 30-60%, or preferably 35% to 50% by volume of the adhesive material. Preferably, thermoplastic and/or rubber may be added in the polymer component. The thermoplastic may be selected from the group consisting of phenoxy resin, polysulfone, polyethersulfone, polystyrene, polyphenylene oxide, polyphenylene sulfide, polyamide, polyimide, polyetherimide, polyetherimide and silicone block copolymer, polyurethane, polyester, polycarbonate, acrylic resin, styrene, acrylonitrile, and styrene block copolymers. The rubber may be nitrile-butadiene rubber (BNR).

The heat conductive filler comprises ceramic or metal powder, e.g., zirconium nitride, boron nitride, aluminum nitride, silicon nitride, aluminum oxide, magnesium oxide, zinc oxide, silicon oxide, titanium oxide, silicon carbide, gold, silver, aluminum or mixture thereof. The heat conductive filler is evenly dispersed in the polymer component and comprises 40% to 70%, or preferably 50% to 65%, by volume of the adhesive material.

In summary, the illumination apparatus uses an insulating adhesive layer to combine the light module with the heat sink. With large insulating covering area, it is elective to avoid electric arc events. The insulating adhesive layer has a heat conductivity greater than 0.5 W/m-K, a thickness of 0.02 to 10 mm, and is able to provide adhesive strength of at least 300 g/cm$^2$. The insulating adhesive layer of high adhesive strength firmly secures the light module to the heat sink without the need of fixing components such as screws. Moreover, the insulating adhesive layer has good performances on impact endurance and insulation. For example, it can withstand a voltage of at least 500V, or even more, such as 1 kV or 10 kV.

The above-described embodiments of the present invention are intended to be illustrative only. Numerous alternative embodiments may be devised by persons skilled in the art without departing from the scope of the following claims.

We claim:

1. An illumination apparatus, comprising:

a heat sink;

at least one light module disposed on the heat sink; and an insulating adhesive layer disposed between the heat sink and the light module to combine the light module with the heat sink;

wherein the insulating adhesive layer comprises a polymer component in which a heat conductive filler is evenly dispersed, the polymer component comprises thermoset epoxy resin, the insulating adhesive layer has a heat conductivity greater than 0.5 W/m-K, a thickness of 0.02-10 mm, a strength of the insulating adhesive layer adhered to the heat sink and to the light module is greater than 300 g/cm$^2$, wherein the insulating adhesive layer can withstand a voltage of at least 500V without an electric arc, and wherein the insulating adhesive layer exhibits a hardness of 65A to 98A according to ASTM D2240A.

2. The illumination apparatus of claim 1, wherein a covered area of the insulating adhesive layer is greater than a covered area of the light module.

3. The illumination apparatus of claim 1, wherein a ratio of a covered area of the light module to a covered area of the insulating adhesive layer is between 65% to 95%.

4. The illumination apparatus of claim 1, wherein the light module comprises a lighting device and a circuit substrate, and the lighting device is disposed on the circuit substrate.

5. The illumination apparatus of claim 4, wherein a ratio of a covered area of the light module to a covered area of the insulating adhesive layer between 25% to 93%, and wherein the lighting device can withstand a voltage between 1 kV to 10 kV without an electric arc.

6. The illumination apparatus of claim 4, wherein a ratio of a covered area of the light module to a covered area of the insulating adhesive layer is between 100% to 300%, and wherein the lighting device can withstand a voltage between 0.8 kV to 3.4 kV without an electric arc.

7. The illumination apparatus of claim 1, further comprising a base shell, the heat sink sticking out of the base shell.

8. The illumination apparatus of claim 7, wherein the heat sink has a cylindrical shape, and the light module is disposed on at least one of top and lateral surfaces of the heat sink.

9. The illumination apparatus of claim 8, wherein the insulating adhesive layer covers a top of the heat sink and extends downward to exceed an area where the light module is located.

10. The illumination apparatus of claim 7, wherein the heat sink has a polygonal columnar shape, and a light module is disposed on at least one of top and lateral surfaces of the heat sink.

11. The illumination apparatus of claim 10, wherein the insulating adhesive layer covers a top of the heat sink and extends downward to exceed an area where the light, module is located.

12. The illumination apparatus of claim 1, wherein thermoset epoxy resin comprises a bisphenol a epoxy resin.

13. The illumination apparatus of claim 1, wherein the polymer component further comprises a thermoplastic.

14. The illumination apparatus of claim 1, wherein the heat conductive filler is selected from the group consisting of zirconium nitride, boron nitride, aluminum nitride, silicon nitride, aluminum oxide, magnesium oxide, zinc oxide, silicon oxide, titanium oxide, silicon carbide, gold, silver, aluminum and mixtures thereof.

15. The illumination apparatus of claim 1, wherein the insulating adhesive layer combines the heat sink with the light module at a temperature greater than 50° C.

16. An illumination apparatus comprising:

a heat sink;

at least one light module disposed on the heat sink; and an insulating adhesive layer disposed between the heat sink and the light module to combine the light module with the heat sink;

wherein the insulating adhesive layer comprises a polymer component in which a heat conductive filler is evenly dispersed, the polymer component comprises thermoset epoxy resin, the insulating adhesive layer has a heat conductivity greater than 0.5W/m-K, a thickness of 0.02-10mm, a strength of the insulating adhesive layer adhered to the heat sink and to the light module is greater than 300g/cm$^2$, wherein the insulating adhesive layer can withstand a voltage of at least 500V without an electric arc;

a base shell in which the heat sink sticks out of the base shell; and a transparent cover of which a bottom connects to the base shell, and the heat sink sticks out of the base shell by ½ to ½ of a height of the transparent cover.

17. An illumination apparatus comprising:

a heat sink;

at least one light module disposed on the heat sink; and an insulating adhesive layer disposed between the heat sink and the light module to combine the light module with the heat sink;

wherein the insulating adhesive layer comprises a polymer component in which a heat conductive filler is evenly dispersed, the polymer component comprises thermoset epoxy resin, the insulating adhesive layer has a heat conductivity greater than 0.5W/m-K, a thickness of 0.02-10mm, a strength of the insulating adhesive layer adhered to the heat sink and to the light module is greater than 300g/cm$^2$, wherein the insulating adhesive layer can withstand a voltage of at least 500V without an electric arc, wherein the insulating adhesive layer exhibits a thermal resistance less than 0.5° C./W according to ASTM D5470.

* * * * *